United States Patent [19]

Johnson

[11] 4,117,728

[45] Oct. 3, 1978

[54] PIPETTE

[75] Inventor: Leighton Clifford Johnson, Edwardsburg, Mich.

[73] Assignee: Miles Laboratories, Inc., Elkhart, Ind.

[21] Appl. No.: 863,223

[22] Filed: Dec. 22, 1977

[51] Int. Cl.[2] ..... B01L 3/02

[52] U.S. Cl. ..... 73/425.6; 422/100

[58] Field of Search ..... 73/425.4 P, 425.6; 222/309, 386; 23/253, 259, 292

[56] References Cited

U.S. PATENT DOCUMENTS

| | | | |
|---|---|---|---|
| 2,792,834 | 5/1957 | Kapelsohn | 73/425.6 |
| 3,492,867 | 2/1970 | Bull et al. | 73/425.6 |
| 3,494,201 | 2/1970 | Roach | 73/425.4 |
| 3,675,492 | 7/1972 | Tejera | 73/425.6 |

*Primary Examiner*—S. Clement Swisher

*Attorney, Agent, or Firm*—Roger N. Coe

[57] ABSTRACT

A pipette capable of accurately picking up, mixing and dispensing liquids in predetermined ratios without instrument calibration is disclosed. The pipette apparatus has cooperable shoulder means for accurately regulating relative movement of the pipette plunger means and casing to permit the sequential and separate pick up of different liquids, the mixing of the different liquids within the apparatus and the dispensing of the mixed liquids from the apparatus.

10 Claims, 10 Drawing Figures

PIPETTE

FIELD OF THE INVENTION

The present invention relates to pipette apparatus and, more particularly, to apparatus which accurately picks up, mixes and dispenses liquids in predetermined ratios without instrument calibration.

BACKGROUND OF THE INVENTION

There is a need for simplified apparatus capable of accurately measuring and/or mixing different liquids very precisely. The pipette is a common laboratory device for obtaining small samples of liquid which are to be diluted or mixed. Conventional pipettes have the disadvantage of requiring calibration and the further drawback of requiring time consuming, painstaking care in order to achieve accuracy. Moreover, there are inherent safety problems associated with the oral pipetting of certain solutions.

To avoid the necessity of having to use separate pipettes for picking up and dispensing different liquids, a dual-piston syringe was developed which has the capability of sequentially picking up and dispensing two liquids. While this dual-piston syringe has the benefit of accuracy, precision and speed, it lacks the ability to effect mixing or dilution of multiple liquids prior to the time they are dispensed from the syringe.

Certain procedures require that multiple liquids be diluted or mixed in predetermined ratios before being dispensed. Prior to the present invention there was no way of satisfactorily diluting or mixing different liquids in a pipette. Thus, for a uniform mixture to be dispensed from a pipette it was first necessary to premix the liquids in the separate container to obtain a mixture which was then drawn into a pipette from which the mixture could be dispensed. This procedure was both time consuming and wasteful of materials. Furthermore, the required sequence of steps increased the opportunity for contamination of the liquids.

SUMMARY OF THE INVENTION

An object of the present invention is to provide an improved pipette.

Another object of the present invention is to provide a pipette capable of accurately and rapidly mixing precisely measured quantities of different liquids.

Still another object of the present invention is to provide a pipette which is capable of picking up multiple liquid samples in precise ratio and of completely mixing the liquids before they are dispensed.

A further object of the present invention is to provide a pipette which can be used without operator calibration and without pipetting error.

In accordance with the present invention plunger operated apparatus having a casing with piston type plunger means inside the casing and means connected to the plunger means for moving the plunger means axially within the casing are provided. Cooperable plunger and casing shoulder means are provided for accurately regulating relative movement of the plunger means and casing to permit the sequential and separate pickup of different liquids by the apparatus, the mixing of the different liquids within the apparatus and the dispensing of the resulting mixed liquids from the apparatus. The apparatus permits predetermined ratios of liquids to be picked up and mixed accurately and rapidly to obtain a homogeneous mixture which can then be dispensed.

BRIEF DESCRIPTION OF THE DRAWINGS

Other and further objects, advantages and features of the invention will be apparent to those skilled in the art from the following detailed description thereof, taken in conjunction with the accompanying drawings, in which.

DESCRIPTION OF THE PREFERRED EMBODIMENTS

The pipette apparatus of the present invention is characterized by having cooperable plunger and casing shoulder means which accurately regulates relative movement of the pipette plunger and casing to permit the sequential and separate pickup of different liquids, the mixing of the different liquids within the apparatus and the dispensing of the resulting mixed liquids from the apparatus.

Figure 1:
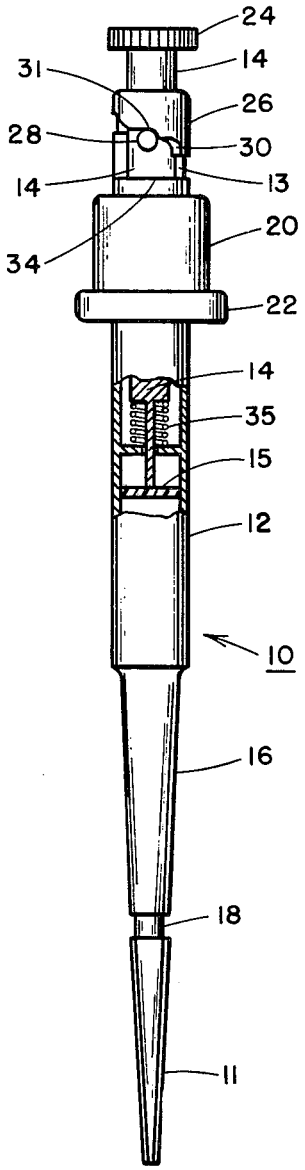
FIG. 1 is a plan view of a pipette, in partial cross section, in accordance with the present invention.

Turning now to FIG. 1 of the drawings, pipette 10 is illustrated as having a tapered tip 11 attached to one end of a generally cylindrical barrel or casing 12, said casing being formed at the other end with shoulder means in the form of cutaway portions defining a pin guide 13. A plunger 14 extends coaxially into casing 12 and is connected to a piston 15. At its outer end plunger 14 is provided with shoulder means in the form of a radially outwardly directed pin or detent member 28 replaceably positioned in a suitable bore and adapted to coact with pin guide 13 in a manner to be described hereinafter.

It will be understood that the exact configuration of casing 12 is not critical to the invention. In FIG. 1 casing 12 is shown having a tapered end portion 16 terminating in a reduced neck portion 18 to which tapered tip 11 is attached in a manner well known in the art. An enlarged cylindrical shoulder member 20 is attached to the casing 12 adjacent pin guide 13, said member being formed with a radially outwardly directed annular flange 22 adjacent the inner end thereof, which flange serves basically to facilitate holding of the pipette in an individual's hand while operating plunger 14. The described elements relating to casing 12 extending from reduced neck portion 18 to enlarged shoulder member 20 are well known elements of piston type prior art pipettes. These various component elements can be made from any suitable material, such as metal, glass, rubber, or plastic.

Tapered tip 11 can be made to be removable and suitably attached by friction, threaded means or the like to reduced neck portion 18 of casing 12. The tapered tip can also be made of any suitable material, such as metal, glass, rubber, or plastic, and can, if desired, be disposable.

Plunger 14 is provided at its outer end with an enlarged head 24, said plunger extending coaxially into casing 12 where it is operatively connected in known manner to piston 15. In a well known manner, outward movement of plunger 14 and piston 15, creates a vacuum inside casing 12, whereas inward movement of said plunger and piston creates pressure in said casing. As hereinafter described, movement of plunger 14 and piston 15 is constrained by coaction of pin 28 and pin guide 13. The shape of pin guide 13 is best seen in the pin guide layout illustrated in FIG. 2.

Figure 2:
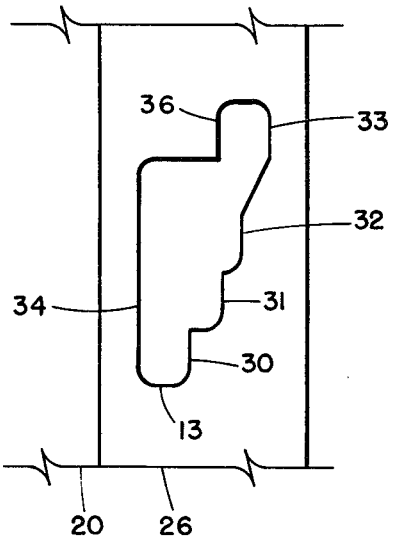
FIG. 2 is an enlarged view of the pin guide layout corresponding to the cooperable shoulder means present in FIG. 1 and further illustrated by FIGS. 3–10.

Referring to FIG. 2, it will be seen that pin guide 13 is constructed to have a number of different surface portions or notches 30 to 33 for regulating movement of pin 28. These surface portions or notches, together with pin 28 comprise cooperable shoulder means on casing 12 and plunger 14 defining positions to which pin 28 may be moved and thereby corresponding positions to which plunger 14 can be moved between its outermost position, represented by the outer surface of notch 33, and its innermost position represented by base line surface 34.

Ordinarily, pin 28 is maintained against an outer surface portion of pin guide 13 in one of the notches 30 to 33 by action of spring 35 (FIG. 1) inside casing 12. By pressing inwardly on head 24 of plunger 14 it is possible to move pin 28, within the confines of pin guide 13, toward base line surface 34 from positions in contact with the surfaces of notches 30, 31 and 32 and toward base line surface 36 from a position in contact with the outer surface of notch 33. The significance of the various notches 30 to 33 will be explained in greater detail in connection with a description of FIGS. 3 through 10.

Figure 3:
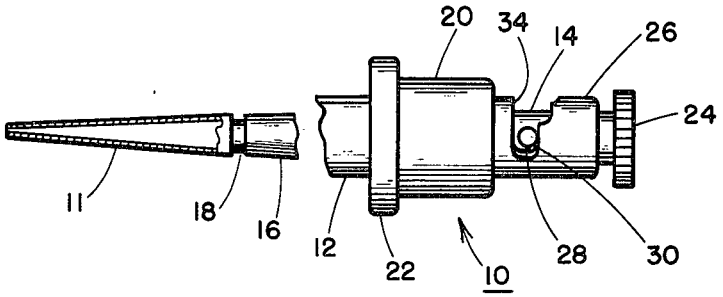
FIGS. 3–10 are side views, partially broken away, of the pipette of FIG. 1 illustrating in sequence various positions of the plunger keyed to different positions of the cooperable shoulder means and showing the pickup, mixing and dispensing of liquids from the tip of the pipette.
Figure 4:
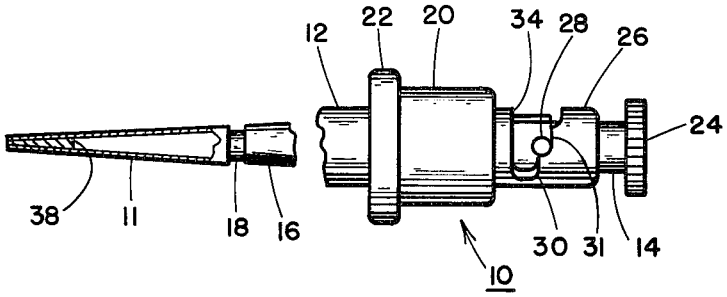

In FIGS. 3–10 the opposite end portions of pipette 10 are shown in juxtaposition in order to facilitate an understanding of the operation of the pipette. In FIG. 3 pin 28 is illustrated in a first position, being biased into contact with the outer surface of retaining notch 30 near base line surface 34 of pin guide 13 by action of spring 35. In this position piston 15 is at essentially the innermost position in casing 12 in which it can be disposed under the constraints of the coaction of pin 28 and pin guide 13. This is the position for plunger 14 before any liquid is drawn up into tapered tip 11. By inserting tapered tip 11 in a liquid (not shown) while pin 28 rests within notch 30 of pin guide 13, and then manually rotating head 24, and thereby plunger 14, clockwise as viewed from the right in FIGS. 3 to 10, pin 28 moves into registry with notch 31 of pin guide 13 whereupon spring 35 moves plunger 14 axially outwardly in casing 12 to the position thereof shown in FIG. 4 wherein pin 28 engages the surface of notch 31. The outward plunger movement causes a vacuum to occur within tip 11, which vacuum causes a precisely measured amount of liquid 38 to be drawn up into tip 11 as illustrated in FIG. 4.

Removal of tip 11 from the first liquid and insertion thereof into a second liquid permits a precisely measured amount of the latter to also be drawn into tip 11. This is accomplished by further clockwise rotation of plunger 14 to position pin 28 in registry with notch 32, whereupon spring 35 moves plunger 14 outwardly to the position represented by contact of pin 28 with the surface of notch 32 shown in FIG. 5. Such outward plunger movement causes the second liquid 40 to be drawn up into tip 11 as is also shown in FIG. 5.

Figure 6:
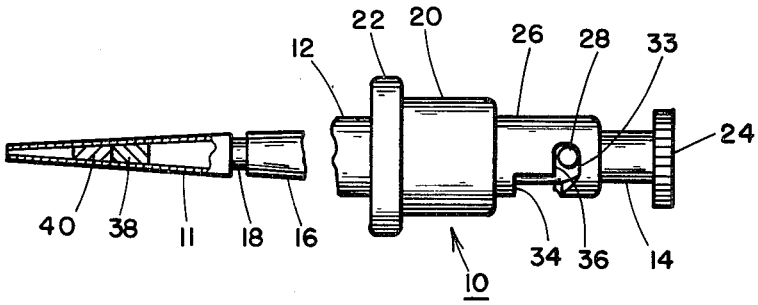

Still further clockwise rotation of plunger 14 causes spring 35 to move pin 28 along the outer surface of guide 13 into contact with the outer surface of notch 33, while at the same time causing corresponding outward movement of plunger 14 to the position of FIG. 6. If this latter movement occurs while tip 11 is withdrawn from any body of liquid, liquids 38 and 40 will move inwardly as layers within tip 11, as illustrated in FIG. 6, and an air space will result in the outer end of the tapered tip 11 as shown.

Figure 5:
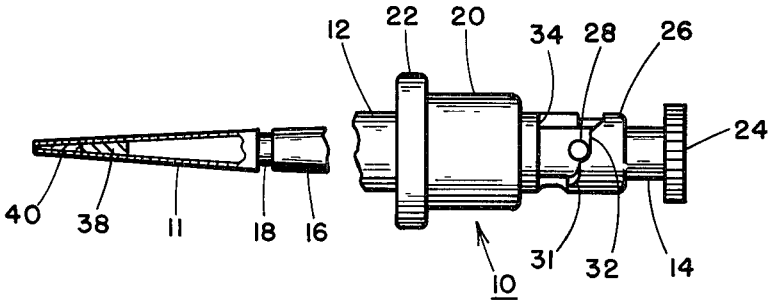

Liquids 38 and 40, shown in FIGS. 5 and 6, are for all practical purposes separate liquid segments even at their interface. Thus, if liquids 38 and 40 in FIG. 5 were dispensed or expelled from tapered tip 11 mixing of the liquids would occur only after being dispensed. However, because of the coaction of pin 28 and guide 13 the present invention permits mixing of liquids to occur inside tip 11 in order that a homogeneous mixture of liquids can be dispensed from pipette 10. The mixing and dispensing of the liquids are described in connection with FIGS. 7 through 10.

Figure 7:
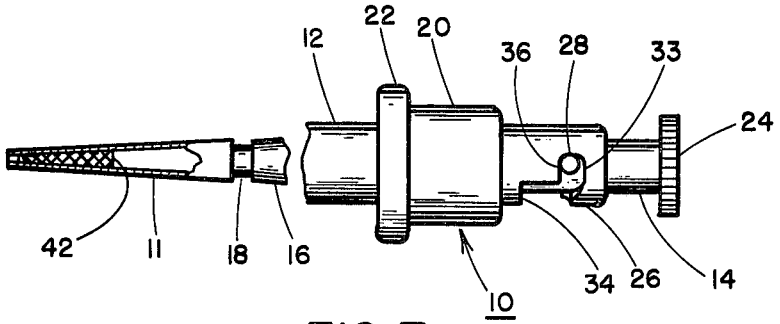
Figure 8:
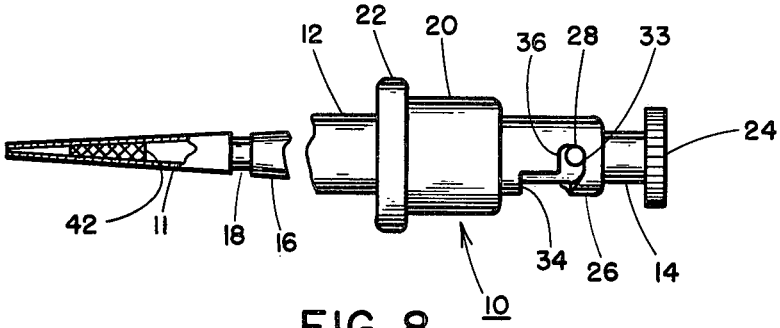

Referring specifically to FIGS. 6, 7 and 8 it will be seen that alternate application and release of axially inwardly directed digital pressure on plunger head 24 against the bias of spring 35 causes reciprocating axial movement of plunger 14 as pin 28 moves into alternate engagement with base line surface 36 and the outer surface of notch 33. Such plunger movement causes the liquids inside tip 11 to move outwardly within tip 11 to the position thereof shown in FIG. 8. Such movement causes the liquids to become subjected to extremely effective vortex mixing, resulting in a uniform and homogenous mixture of said liquids. The extent of mixing can be controlled by the number of times plunger 14 is reciprocated as described. Moreover, the mixing action can be as intense or violent as one desires depending upon the rapidity of plunger reciprocation.

Figure 9:
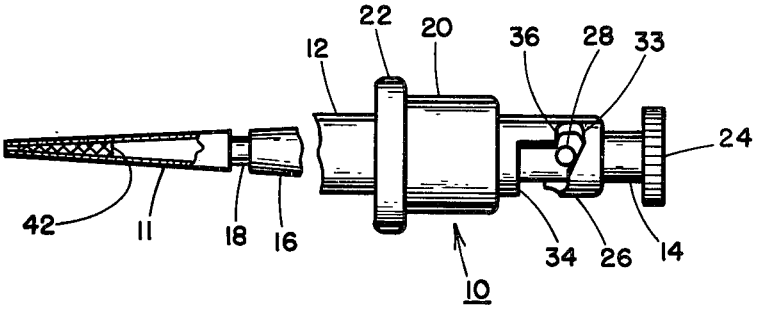
Figure 10:
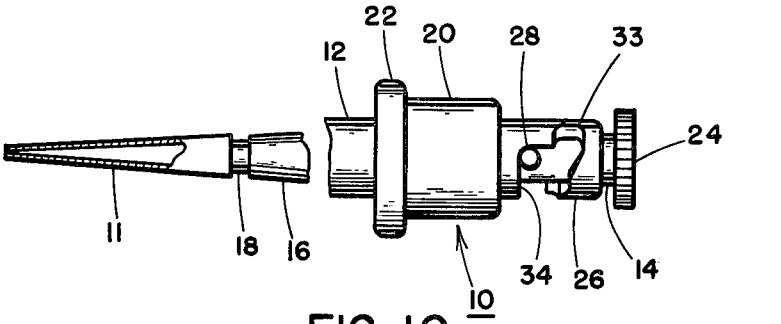

Upon completing the mixing of liquids inside tapered tip 11, dispensing thereof can be accomplished by counterclockwise rotation of plunger 14 to the position illustrated in FIG. 9, wherein pin 28 is laterally offset from the base line surface 36, and then, by application of digital pressure to head 24, depressing plunger 14 against the bias of spring 35 the full extent permitted by movement of pin 28 into contact with base line surface 34 such plunger movement causes the precisely measured mixed liquids inside retaining tip 11 to be expelled or dispensed from tip 11 as the parts of pipette 10 are moved to the positions thereof illustrated in FIG. 10.

Since pin guide 13 can be machined quite accurately with respect to any desired configuration, pipettes can be made which eliminate any necessity for calibration. Thus, uniform and consistent results can be achieved each time the pipette is used, eliminating pipetting errors typically associated with the use of pipettes. The pipettes of the present invention also result in minimum sample preparation time due to the absence of any need for priming the pipette, any need to calibrate the pipette, and the ease and precision with which the pipette can be operated by simply manipulating plunger head 24 to achieve precise positioning of plunger 14 and piston 15 by coaction of pin 28 with pin guide 13. Minimum sample preparation time also results from the fact that uniform and homogeneous mixing of liquids can be achieved inside the pipette tip prior to the dispensing of the liquids.

As previously indicated, when the liquids are reciprocated axially within the conical tip, extremely effective vortex mixing occurs. The mixing action illustrated by FIGS. 7–9 is in contrast to the segmented movement of liquids 38 and 40 illustrated in FIGS. 5 and 6 in which very little, if any, mixing occurs at the liquid interface. Thus, when the dual-piston syringe of the prior art draws up two liquids and then dispenses the liquids the liquids are dispensed or ejected in reverse order of their pickup, such that the second liquid to be picked up is the first liquid dispensed. It is because of the fact that the liquids inside a dual-piston syringe are stratified that little, if any, mixing occurs and whatever mixing does occur is nonuniform mixing at the interface of the two liquids. In contrast, the pipette of the present invention achieves the desideratum of a uniform and homogeneous mixture of liquids.

It will be appreciated that the apparatus illustrated in the drawings is a preferred embodiment of an invention designed primarily for operation using thumb pressure on plunger head 24 against the bias of spring 35 to move piston 14 from one position to another. Obviously, the apparatus can be adapted for operation according to other convenient formats. For example, pin 28 can be elongated to function as a "shifting lever" to similarly move piston 14 from one position to another.

The pipette 10 can be made substantially contamination free by using replaceable tips and having all the mixing occurring within a replaceable tip. Obviously, pin guide 13 can be formed in a replaceable portion of casing 12 to provide for selective changing the volume, number of liquids to be picked up and the volumetric ratio of the liquids, within the capacity limitations of the pipette. Thus, a one-in-four dilution or one-in-fifty dilution can be readily achieved depending upon the configuration of the pin guide. Different proportions, meeting the exact specifications required for a particular operation, can be obtained by selecting a casing portion formed with a pin guide 13 capable of effecting the desired result. It will also be apparent to one skilled in the art that an alternative to interchangeable pin guide means would be to provide shoulder means forming one or more of the surfaces 30 to 33, which shoulder means is selectively moveable axially to alternative operation positions.

From the foregoing, it will be seen that this invention is well adapted to attain all of the ends and objects hereinabove set forth, together with other advantages which are obvious and inherent to the system. Apparatus of the present invention has the advantages of convenience, simplicity, relative inexpensiveness, positiveness, effectiveness, accuracy, and directness of action. The invention permits precise dilution of liquids or mixing to occur inside a pipette and can even be automated.

Obviously, many other modifications and variations of the invention as hereinbefore set forth may be made without departing from the spirit and scope thereof.

What is claimed is:

1. In a pipette or the like having a barrel provided at one end with a restricted opening, a piston within said barrel having a plunger attached thereto and coaxially projecting from the other end of said barrel, the improvement which comprises cooperable shoulder means on said barrel and plunger relatively movable to a plurality of operative positions, said shoulder means defining first and second axially spaced positions of said plunger with respect to said barrel and at least one third position of said plunger located intermediate said first and second plunger positions, said shoulder means defining said plunger positions at respectively different operative positions.

2. The improvement of claim 1 wherein said shoulder means defines two axially spaced third plunger positions.

3. The improvement of claim 1 wherein said first and second positions of said plunger are respectively fully advanced and retracted positions thereof and said cooperable shoulder means, when in the operative positions defining said second plunger position, also defining a fourth plunger position spaced from said first position and permitting reciprocating movement of said plunger between said second and fourth positions.

4. The improvement of claim 3 which additionally comprises means biasing said plunger axially toward said second position.

5. The improvement of claim 1 wherein the relative movement of said shoulder means is rotary movement coaxial with said plunger.

6. The improvement of claim 1 wherein said cooperable shoulder means comprises a detent member carried by said plunger and engageable with surface portions of guide means carried by said barrel.

7. The improvement of claim 6 wherein said guide means comprises a tubular member coaxially surrounding said plunger and having cutaway portions defining said surface portions, and wherein said detent projects radially from said plunger.

8. A device for collecting, mixing and dispensing liquids which includes:

an elongated chamber;

a restricted passageway located at one end of said chamber adapted to accommodate the passage of liquids into said chamber;

a plunger operated piston member forming a wall in said chamber moveable between a fully retracted piston and an advanced position, the movement of said piston member in said chamber being perpendicular to the cross-section of said chamber creating a force upon said restricted passageway and any liquids in said passageway which force is dependent upon the direction of movement of said piston member; and guide means attached to said elongated chamber, said guide means comprising a tubular member coaxially surrounding and engaging detent means on said plunger for regulating the movement of said plunger to at least four operative positions of the plunger operated piston member, including the fully retracted position, the advanced position and at least two intermediate positions.

9. The device of claim 8 which additionally comprises means for biasing said plunger operated piston member axially toward said fully retracted position.

10. The method of collecting, mixing and dispensing liquids which includes:

drawing a first liquid through a restricted inlet passageway located at one end of an elongated chamber to a first position inside said elongated chamber;

drawing the first liquid to a second position inside said elongated chamber while simultaneously drawing a second liquid through the inlet passageway into said elongated chamber such that the first and second liquids form contiguous, but substantially separate liquid layers inside said elongated chamber;

moving said first and second contiguous liquid layers longitudinally within said elongated chamber and away from said inlet passageway so as to form an air space between said inlet passageway and the second liquid;

causing reciprocating movement of the first and second liquids entirely within the elongated chamber to cause mixing of the first and second liquids; and then dispensing the resulting mixed liquids from the restricted inlet passageway of said elongated chamber.

* * * * *